United States Patent [19]

Lane et al.

[11] 4,204,287

[45] May 27, 1980

[54] KNOCK-DOWN SOFA BED WITH HINGED MATTRESS

[76] Inventors: Manning Lane, 3185 Patrisal Ct., Cincinnati, Ohio 45236; Warren J. Hauck, 8020 Brooks Rd., Harrison, Ohio 45030; Roy O. Sweeney, 5584 Clearidge La., Cincinnati, Ohio 45239

[21] Appl. No.: 939,392

[22] Filed: Sep. 5, 1978

[51] Int. Cl.[2] ..... A47C 17/40

[52] U.S. Cl. ..... 5/18 R; 5/13; 5/29

[58] Field of Search ..... 5/12, 13, 14, 17, 18 R, 5/29; 297/440

[56] References Cited

U.S. PATENT DOCUMENTS

| | | | |
|---|---|---|---|
| 3,069,698 | 12/1962 | Miller | 5/17 |
| 3,900,905 | 8/1975 | Johnson et al. | 5/18 R |
| 3,906,558 | 9/1975 | Alembik | 5/13 |
| 3,973,800 | 8/1976 | Kogan | 297/440 |

*Primary Examiner*—Casmir A. Nunberg

*Attorney, Agent, or Firm*—Frost & Jacobs

[57] ABSTRACT

A sofa bed convertible from a sofa to a bed having a self-supporting stationary section, a first movable section slidably attached to the stationary section, and a second movable section slidably attached to the first movable section. Independently supported spaced arms are removably attached to the sides of the stationary section to serve as arm supports for persons seated on the sofa bed, but not as structural supports for the stationary section. A hollow furniture-type back is removably connected between the arms. A hinged mattress overlies the stationary and movable sections when the sofa bed is being utilized as a bed. The rearmost portion of the mattress may be doubled over so that the resulting double-thickness section may slide rearwardly and upwardly into the hollow back for storage, with the forward part of the mattress forming a resilient seating surface when the sofa bed is being utilized as a sofa. Alternatively, the forwardmost portion of the mattress may be doubled over to form a cushion-like seating surface with the rearwardmost single thickness section sliding into the hollow back for storage.

20 Claims, 5 Drawing Figures

KNOCK-DOWN SOFA BED WITH HINGED MATTRESS

BACKGROUND OF THE INVENTION

1. Field of the Invention

The present invention relates generally to beds, and more particularly to a bed convertible from a sofa and including knock-down features.

2. Description of the Prior Art

A considerable number of sofas convertible to beds have been proposed by prior art workers. The vast majority of these sofa beds operate either foldably, where a plurality of sections are hingedly connected so that the sofa can be converted to a bed by a complex series of horizontal and vertical motions, or extensibly where the sections are withdrawn linearly to provide a planar sleeping surface.

The foldable sofa beds, although having enjoyed the greatest commercial success, require rather complicated operating mechanisms which greatly contribute to the weight of the unit and its manufacturing cost. In addition, since sofa beds of this type generally require a lifting motion, they cannot be used by persons unable to perform heavy lifting. Finally, the mattress overlying the sleeping or sitting surface of foldable sofa beds must undergo considerable bending which greatly reduces the life of the mattress and can further result in damage to the mattress resiliency which makes sleeping or sitting an uncomfortable experience.

Extensible sofa beds have also suffered from similar drawbacks. For example, complex guide mechanisms must be employed to insure that the extensible sections do not jam when the unit is being opened or closed. This problem is due partly to the considerable weight of the operating members. Attempts to reduce the weight of the operating members by eliminating structural material by constructing the sofa bed of lighter weight material have generally resulted in furniture of flimsy construction or increased cost. In addition, the operating mechanisms joining the extensible sections are usually wheels or rollers which are subject to wear and can easily slip from their guiding track, thereby rendering the bed mechanism inoperable.

Conventional extensible sofa beds are generally constructed such that the stationary section is supported entirely by the arms and/or back of the sofa. Hence, the supporting members must possess sufficient structural strength to support the weight of persons seated on the sofa or lying on the sofa bed when it is extended. This, of course, contributes to the overall weight and cost of the unit. In addition, since the stationary section is supported entirely by the arms and/or back of the sofa bed, these members cannot be easily removed for storage or shipment. Although knock-down sofa beds have been proposed, the additional expense of reassembling the mechanically complex units generally outweighs any cost savings experienced in lower shipping costs produced by higher packing densities of the knock-down units.

Finally, prior art extensible sofa beds have not completely solved the problem of mattress storage when the apparatus is not being used as a bed. Some designs have included a multiple section mattress which can be manually stacked when the sofa bed is being used as a seating unit. However, this arrangement results in a seating surface which is positioned at an uncomfortable height from the ground. In addition, inasmuch as the modern emphasis of furniture designers is on low silhouette sofa units, the aesthetic features of such designs are lacking.

SUMMARY OF THE INVENTION

The present invention describes, in general, a sofa bed convertible from a closed position forming a seating unit to an opened position forming a bed. The sofa end is made up of a self-supporting rectangular frame-like horizontal stationary section formed by a pair of spaced parallel end frame members joining spaced parallel front and rear frame members, the stationary section being supported from the floor entirely by four legs positioned near the corners of the frame. The uppermost portion of the stationary section includes a resilient horizontal surface defining a seating platform when the sofa bed is in the closed position. Since the stationary section is self-supporting, it need not depend on support from the sofa arms or back as in previous designs, thereby eliminating much of the weight and mechanical structure inherent in the arms and back which heretofore has been required to support the weight of persons seated on the stationary section.

A first movable rectangular frame-like section formed by a pair of spaced parallel end frame members joining spaced parallel front and rear frame members and supporting a resilient horizontal surface is slidably connected to the stationary section by means of a rod-like bearing pin connected to the outermost end frame members of the first movable section which slides freely in an elongated slot positioned longitudinally in the end frame members of the stationary section. The first movable section is slidable between a closed position wherein the first movable section underlies the stationary section, and an opened position wherein the first movable section is slid outwardly from the stationary section to a position where the horizontal resilient surfaces of the stationary and first movable sections are substantially co-planar. The outwardly extending rod-like bearing pin attached near the rearmost ends of the first movable section side frame members support the rear portion of the first movable section. Thus reliance on failure-prone wheels or rollers as in prior art designs is eliminated. The forward portion of the first movable section is supported from the floor by a pair of spaced downwardly depending legs bearing wheels at their lower ends positioned near the forward corners of the first movable section.

A second movable rectangular frame-like section formed by a pair of spaced parallel end frame members joining spaced parallel front and rear frame members supporting a resilient horizontal surface, and similar in construction to the first movable section, is slidably connected to the first movable section by a pair of rod-like bearing pins extending outwardly from the second movable section side frame members, the bearing pins slidably communicating with an elongated slot positioned in each of the first movable section side frame members. The bearing pins of the second frame members support the rearmost portion of the second movable section, while the forwardmost end of the second movable section is supported from the floor by a pair of spaced downwardly depending legs bearing wheels at their lower ends positioned near the forwardmost corners of the second movable section. The second movable section is slidable between a closed position where the second movable section underlies the first movable section, and an opened position where the second movable section is slid outwardly from the first movable section to a position where the horizontal resilient surfaces of said first and second movable sections are substantially co-planar. Thus the sofa bed operates linearly and eliminates the folding motions inherent in foldable sofa bed designs. In addition, the simplified construction of the sofa bed of the present invention permits much of the weight of prior art designs to be eliminated, resulting in a less expensive and more reliable unit.

As will become more apparent hereinafter, the stationary, first movable and second movable sections of the sofa bed may be used alone or in combination with furniture-like appurtenances to create various types of extensible bed arrangements. For example, in one preferred embodiment knock-down sofa type arms and back are included with the basic extensible bed structure to complete the sofa bed arrangement. In this preferred embodiment, each of the end frame members of the stationary section includes spaced upwardly and downwardly directed flanges extending substantially the length of the end frame members. Each corresponding arm contains on its innermost surface an upper elongated downwardly extending lip and a lower elongated upwardly extending lip positioned below and parallel to the upper lip, so configured that the upper lip slidably receives the upwardly directed flange on the end frame member, while the lower lip slidingly receives the downwardly directed flange on the end frame member. Thus the arms of the sofa may be easily attached to and removed from the extensible bed frame with a simple sliding movement. The lower edges of each arm contain a pair of spaced caster-like bearings which permit the arms to be easily moved along the floor. Since the arms do not provide structural support for the stationary section, the assembly and disassembly of the arms from the stationary section is greatly facilitated.

In a preferred embodiment a sofa-type back is also provided and extends between the rearmost ends of the arms adjacent the stationary section rear frame member. The back comprises a substantially hollow box-like frame which is removably secured to the arms. Since the arms, back and extensible bed section (when closed) are substantially flat, they may be easily stacked for shipment or storage.

The sofa back includes a forward facing support surface depending downwardly from the upper edge of the back which forms a back rest for persons seated on the sofa. The lower edge of the forward facing support surface is vertically spaced from the resilient horizontal surface of the stationary section to form an opening therebetween extending substantially the width of the horizontal surface of the stationary section. This arrangement forms a cavity within the hollow back for accepting and storing a portion of the resilient mattress used with the sofa bed.

The mattress is formed from a foam or other resilient material, approximately the rearmost one-third of the mattress being hinged so that the rearmost portion of the mattress may be folded to overly a portion of the mattress adjacent the rearmost portion to form a double thickness mattress section, with the remainder of the mattress being of a single thickness. When the mattress is unfolded, it presents a substantially planar sleeping surface overlying the stationary, first movable and second movable sections. However, when the sofa bed is used as a sofa, the double thickness mattress section may be slid rearwardly and upwardly into the hollow cavity of the sofa back with the single thickness mattress section overlying the horizontal surface of the stationary section to form a seating surface. Thus mattress storage is easily faciliated. In addition, the height from the floor of the seating surface formed by the upper surface of the single thickness mattress section is considerably reduced over prior art designs, thereby producing a sofa bed having a contemporary appearance. Alternatively, the forwardmost portion of the mattress may be doubled over to form a cushion-like seating surface with the rearwardmost single thickness sliding into the hollow back for storage.

To facilitate sliding the rearmost end of the mattress upwardly and rearwardly into the hollow back, a number of spaced curved slat-like guide members are attached to the rearwardmost end of the extensible bed section so as to curve rearwardly and upwardly into the hollow back.

A removable footboard section may also be provided at the forward end of the second movable section to improve the appearance of the sofa bed.

DESCRIPTION OF THE PREFERRED EMBODIMENTS

Figure 1:
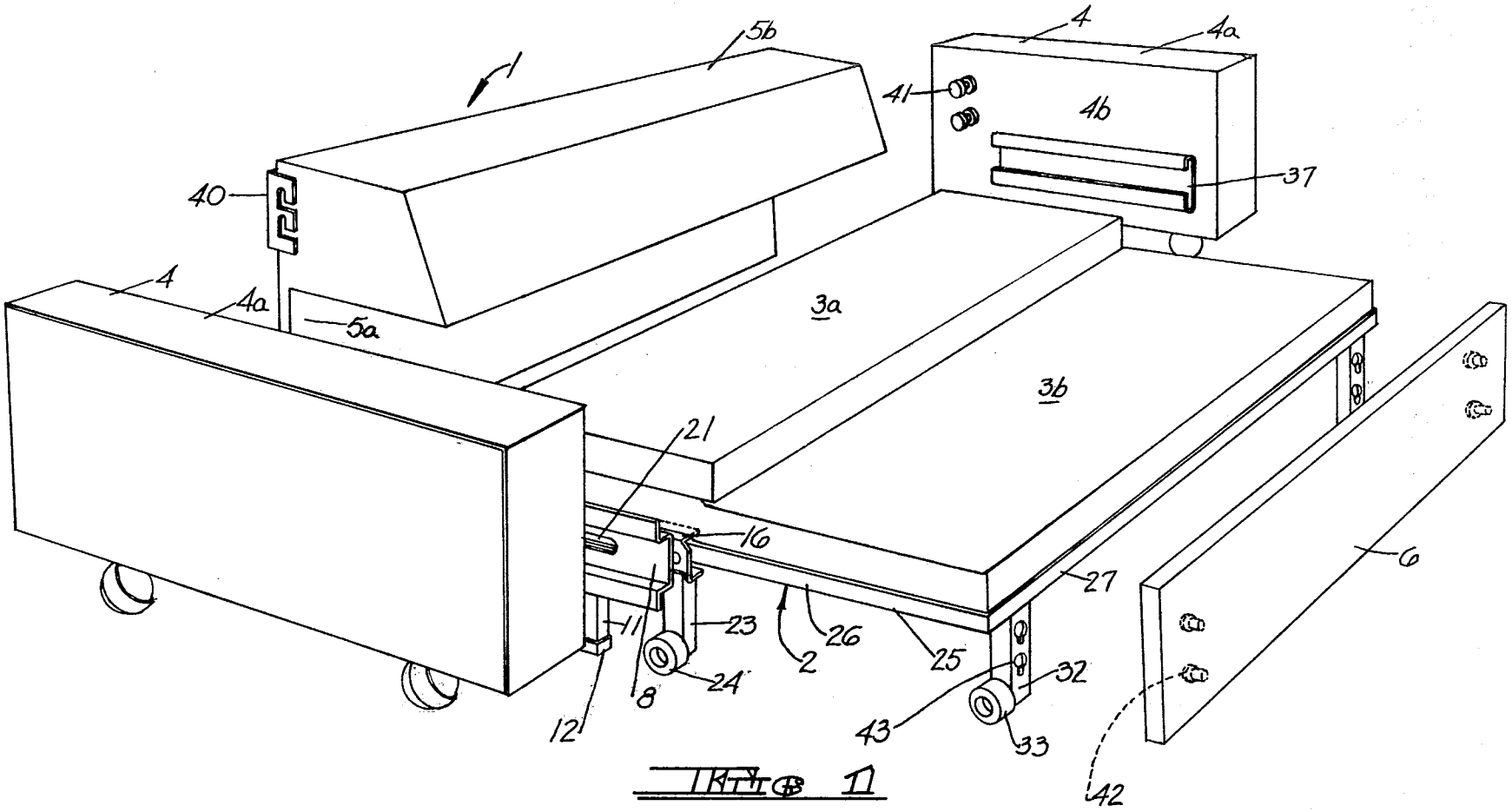
FIG. 1 is an exploded partially cut-away perspective view of the sofa bed of the present invention in the partially opened position supporting a rear hinged mattress.

An exploded perspective view of the sofa bed of the present invention is illustrated generally at 1 in FIG. 1. Sofa bed 1 comprises a self-supporting telescopable extensible bed frame 2, a hinged resilient mattress 3 supported by frame 2, a pair of spaced sofa-type arms 4 removably attached to frame 2, a hollow sofa back 5 removably connected between arms 4, and a footboard 6 removably attached to the forwardmost portion of frame 2.

Figure 3:
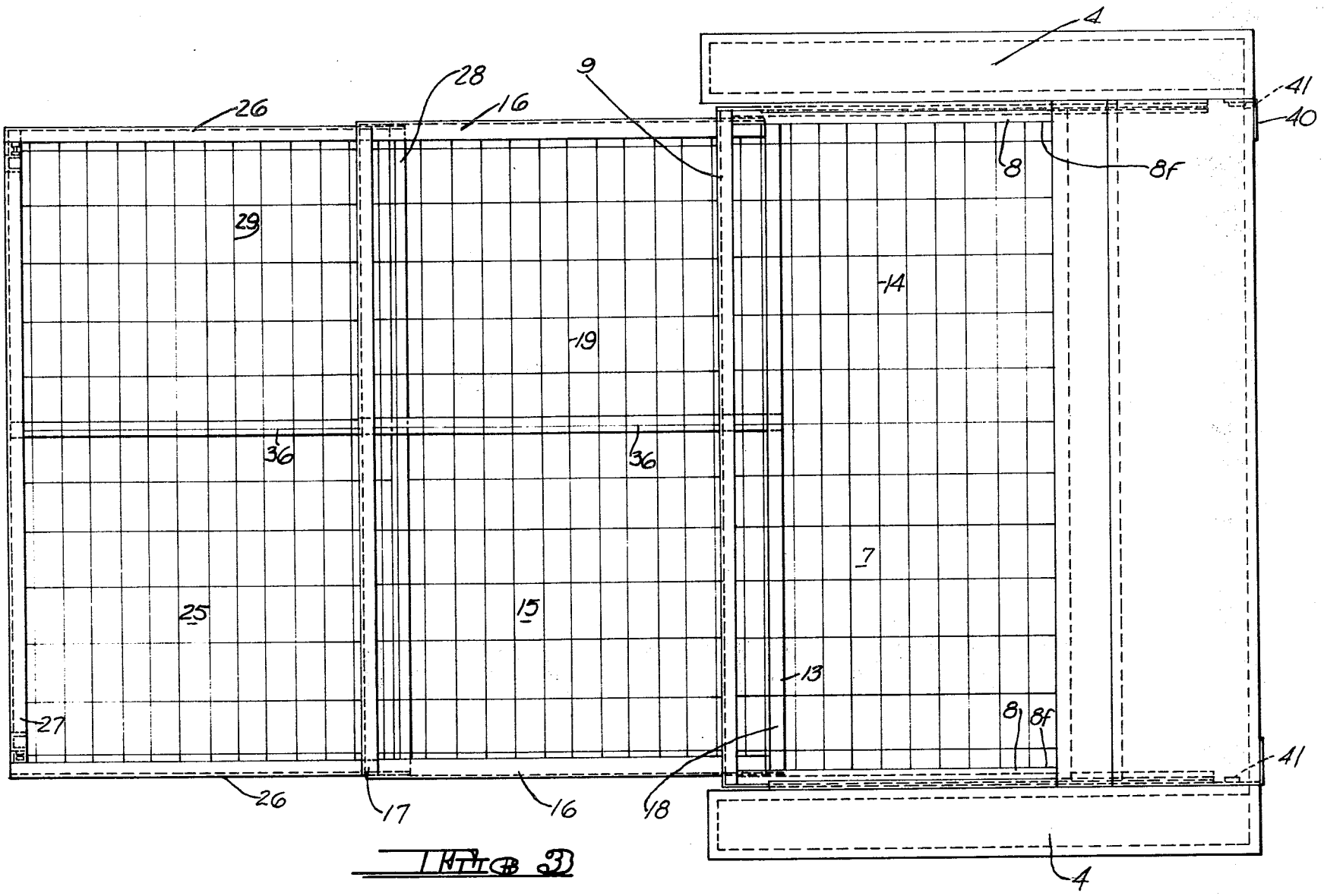
FIG. 3 is a top plan view of the sofa bed of the present invention in the opened position with the mattress removed.

Frame 2 comprises a self-supporting rectangular frame-like horizontal stationary section 7 formed by a pair of spaced parallel end frame members 8 joining spaced parallel front and rear frame members 9 and 10, respectively. As can best be seen in FIG. 4, end frame members 8 comprise a C-shaped channel section having a vertical web **8*a* and outwardly directed horizontal flanges 8*b* and 8*c* extending from the upper and lower edges of web 8*a*. Flange 8*b* terminates in an upwardly turned flange 8*b*, while flange 8*c* terminates in a downwardly turned flange 8*e*. An inwardly directed mesh support web 8*f* is attached to the upper surface of web 8*b* and extends the length of end frame member 8. Front frame member 9 comprises a flat slot-like support extending between and attached to the upper forwardmost surfaces of end frame members 8. Rear frame member 10 (see FIG. 3) is a similar slat-like member extending between and slightly inset from the rearmost ends of end frame members 8**. These front and rear frame members provide structual rigidity to stationary section 7, as well as provide attachment points for the resilient seating surface, as will be explained in more detail hereinafter.

Figure 2B:
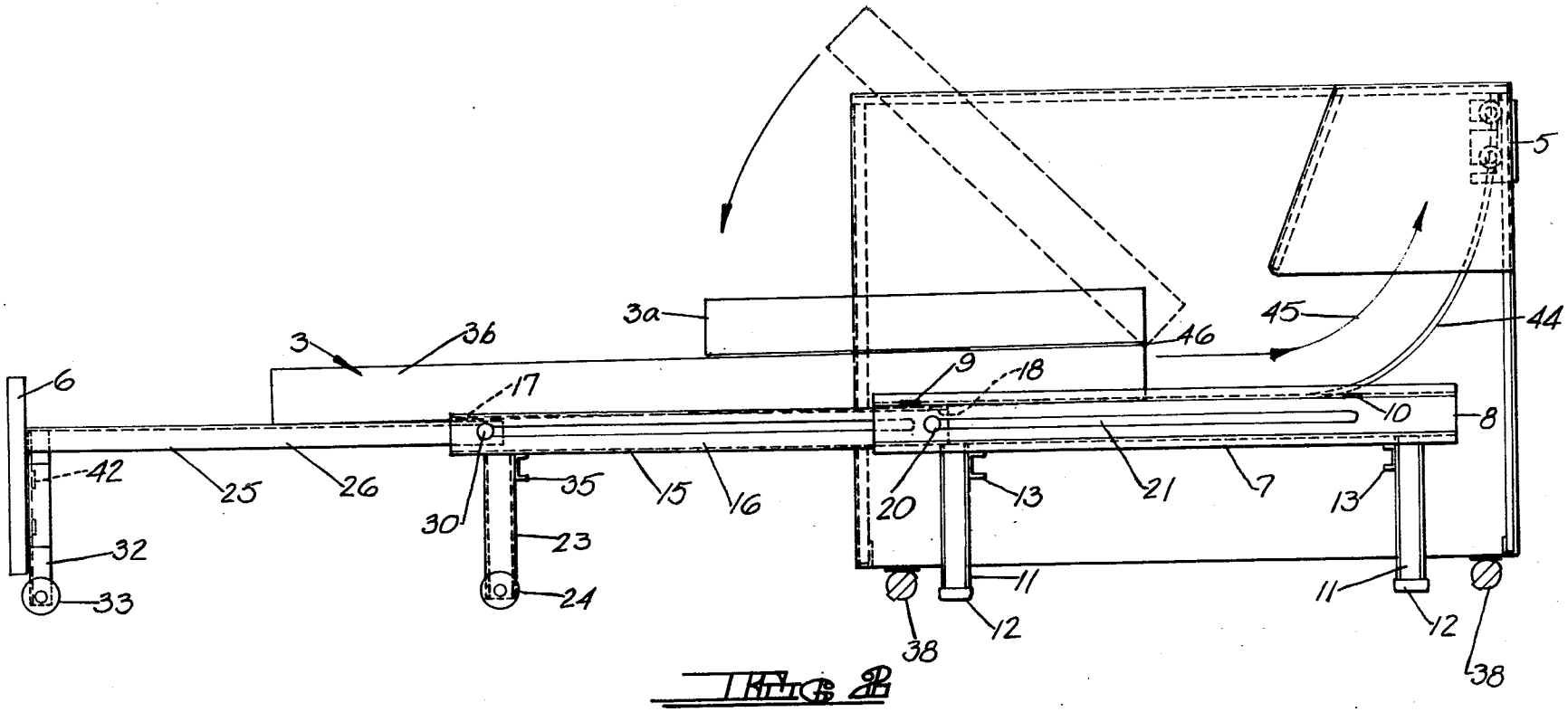
FIG. 2 is a side elevation view of the sofa bed of FIG. 1 in the opened position.

Stationary section 7 is supported from the floor by four downwardly depending legs 11 fashioned of angle stock or the like attached near the ends of end frame members 8 such that the lower surface of flange 8c rests on the upper end of leg 11. The lower ends of legs 11 terminate in cup-like end caps 12 which prevent the bottom ends of legs 11 from marring the floor surface. As can be seen in FIG. 2, legs 11 are inset slightly from the ends of end frame members 8 to improve the stability of stationary section 7. In addition, further bracing of leg members 11 may be accomplished by channel-like support members 13 extending between the upper ends of corresponding legs 11 positioned on opposite ends of extensible bed section 2. It will thus be observed that stationary section 7 is supported from the floor entirely by legs 11, and does not depend upon support by arms 4 or back 5 as in conventional sofa bed designs. By "entirely supported" is meant that the legs, rather than appurtances such as arms, backs, etc. bear the weight of the stationary section and persons sitting or lying thereon. Hence the connections attaching the arms and back to the stationary section need only support the weight of the arms and back, rather than the full weight of persons seated on the unit, as will be described in more detail hereinafter. In addition, considerable structural material can be removed from the arms and back which need only support their own weight resulting in a lighter unit.

The uppermost portion of stationary section 2 includes a resilient horizontal surface 14 which defines a seating platform when the sofa bed is in the closed position. Resilient horizontal surface 14 is preferably constructed of welded wire mesh consisting of spaced parallel longitudinal and transverse wire-like rods welded at their intersections. Such a surface prevents injury from pinched fingers and the like which has occurred with some types of expanded metal mesh or coil spring constructions. In addition, such a mesh constructed of medium mild steel wires or the like provides the proper amount of resiliancy without acquiring a permanent set. The end of the wires comprising the wire mesh may be attached to the lower surfaces of front and rear frame members and the end frame members of stationary section 7 by welding or the like.

A first movable rectangular frame-like section 15 formed by a pair of spaced parallel end frame members 16 is positioned inwardly of end frame members 8 of stationary section 7. End frame members 16 join spaced parallel front and rear frame members 17 and 18, respectively, so that members 16–18 support a resilient horizontal surface 19 made up of a wire mesh similar to horizontal platform 14 of stationary section 7. Front and rear frame members 17 and 18 extend between the front and rear ends, respectively, of end frame members 16. It will be observed that end frame member 16 comprises an inwardly directed horizontal flange 16a which serves as an attachment point for wires forming horizontal surface 19, and a downwardly and inwardly sloping flange 16b attached to the outermost end of flange 16a. Flange 16b terminates in a downwardly depending web section 16c having an inwardly directed lip at its lowermost end. This offset shape of end frame member 16 maintains clearance between end frame members 8 and 16 while maintaining parallelism between the members with minimum friction. This eliminates the need for additional parallelism maintaining mechanisms such as lazy-tong equilizers, etc.

First movable section 15 is slidably connected to stationary section 7 by means of a cylindrical horizontally disposed rod-like bearing pin extending outwardly from the rearmost portion of first movable section end frame member web section 16c. Bearing pin 20 is so arranged as to slidably communicate with an elongated slot 21 extending longitudinally in end frame member 8a of stationary section 7. Bearing pin 20 may be constructed of any suitable friction reducing material such as metal, nylon, etc. to insure effortless telescopic movement between stationary section 7 and first movable section 15. Bearing pin 20 may also be provided with a flanged head section 22 positioned adjacent the outermost surface of end frame member 8 to prevent bearing pin 20 from becoming disengaged from slot 21. The forwardmost and rearwardmost ends of slot 21 provide movement limiting stops for first movable section 15.

As can be seen, first movable section 15 is slidable between a closed position wherein the resilient horizontal surface 19 of first movable section 15 underlies the horizontal resilient surface 14 of stationary section 7 to form a seating surface atop resilient horizontal surface 14, and an opened positioned wherein first movable section 15 is slid outwardly from beneath stationary section 7 to a position where the horizontal resilient surface 14 of stationary section 7 and horizontal resilient surface 19 of first movable section 15 are substantially co-planar as can best be seen in FIG. 2.

The outwardly extending rod-like bearing pins 20 operate generally to support the rear portion of first movable section 15. The forward portion of first movable section 15 is supported from the floor by a pair of spaced downwardly depending legs positioned near the forward corners of first movable section 15 and attached at their upper ends to the lower surface of flange 16d. Legs 23 may be constructed of angle members similar to the construction of legs 11 of stationary section 7; however, legs 23 bear rotatably wheels 24 at their lowermost ends which rotatably communicate with the floor to facilitate movement between first movable section 15 and stationary section 7. It will be observed that legs 23 are positioned inwardly of legs 11 so as to be adjacent thereto when the sofa bed is in the closed position.

A second movable rectangular frame-like section 25, similar to first movable section 15, is slidably connected to first movable section 15. Second movable frame section 25 comprises a pair of angle-shaped spaced parallel end frame members 26 spaced inwardly of end frame members 16 comprising an inwardly directed flange 26a and a downwardly depending leg 26b. End frame members 26 join spaced parallel front and rear frame members 27 and 28, respectively, in a manner similar to that described hereinbefore for first movable section 15. The front and rear frame members and the end frame members support a resilient horizontal surface 29 comprised of a wire mesh similar to horizontal resilient surface 19 of the first movable section 15.

Second movable section 25 is slidably connected to first movable section 15 by a horizontally disposed cylindrical rod-like bearing pin 30 extending outwardly from the rear portion of end frame 26b, which slidably communicates with an elongated slot 31 extending longitudinally in end frame member 16c of first movable section 15. Bearing pin 30, which is similar in construction to bearing pin 20, supports the rearmost portion of second movable section 25, while the forwardmost end of second movable section 25 is supported from the floor by a pair of spaced downwardly depending legs 32 attached to the downwardly directed web portion of angle-shaped front frame member 27 and positioned near the forwardmost corners of the second movable section. This construction not only improves the stability of the unit, but also provides an attachment point for footboard 6 as will be described hereinafter. Legs 32, which may be channel shaped as shown, include wheels 33 at their lowermost ends. Second movable section 25 is slidable between a closed position where resilient surface 29 underlies resilient surface 19, as can thus be seen in FIG. 4, and an open position where second movable section 25 is slid outwardly from first movable section 15 to a position where horizontal surfaces 19 and 29 are substantially co-planar, as is illustrated in FIG. 2. Thus in the fully extended position, the resilient surfaces of the three sections are substantially co-planar. The specific construction employed in the sofa-bed of the present invention also insures that the sections are self-leveling and conform to variations in floor elevation without being unstable.

Additional bracing may be utilized as required, as for example a transversely extending channel-shaped brace 35 extending between legs 23 of first movable section 15. In addition, one or more slat-like support members 36 may extend between front and rear frame members 17 and 18 beneath resilient surface 19, and between front and rear frame members 27 and 28 beneath resilient surface 29 to provide additional support for the resilient surfaces.

It will be understood by those skilled in the art that the extensible bed section 2 could be used alone in association with a suitable mattress, such as the types to be described hereinafter, to provide a linearly operated easily stowed bed. However, in a preferred embodiment, bed section 2 is combined with knock-down appurtenances such as sofa type arms and back to produce a sofa bed arrangement.

Figure 4:
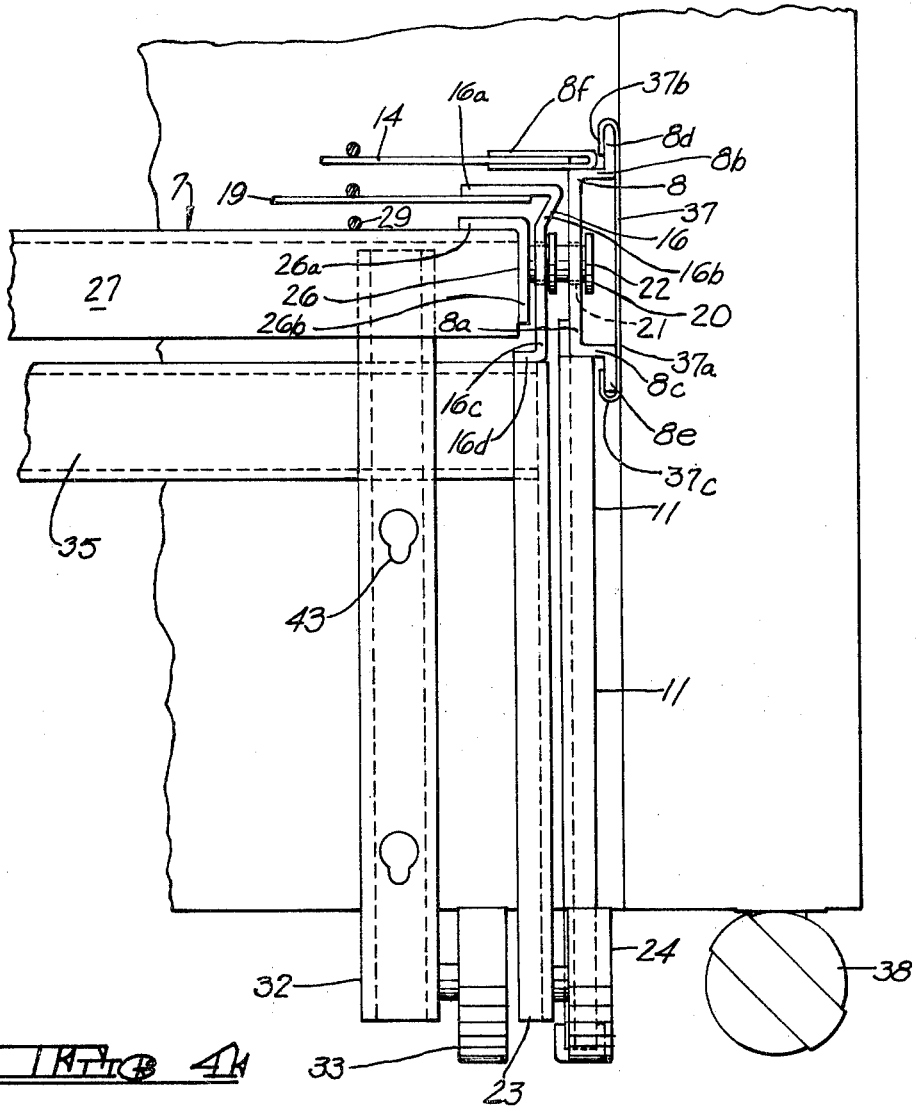
FIG. 4 is an enlarged fragmentary front elevation view partly in cross-section, of the sofa bed of the present invention with the mattress and footboard removed.

As is best shown in FIG. 4, end frame member 8 of stationary section 7 includes a substantially vertical web portion **8*a* terminating at its upper and lower edges in outwardly extending horizontal flanges 8*b* and 8*c*, respectively. Upper flange 8*b* terminates in an upwardly extending lip 8*d*, and flange 8*c* terminates in a downwardly extending lip 8*e*, such that lips 8*d* and 8*e* are substantially co-planar and extend the length of end member 8**.

Sofa type arm 4 includes an upper arm rest section **4*a* and a flat planar inner surface 4*b* mounting an elongated channel-like connector 37 attached to the inner surface 4*b* of arm 4 in any convenient manner. Connector 37 comprises a substantially vertical web portion 37*a* terminating at its upper end in a downwardly extending lip 37*b*, and at its lower end in an upwardly extending lip 37*c*. Upper lip 37*b* is so configured as to slidingly receive upwardly extending flange 8*d* of end frame member 8, and lower lip 37*c* is so configured as to slidingly receive downwardly extending flange 8*e*. Utilizing this arrangement, arms 4 of the sofa bed may be easily attached to and removed from the extensible bed frame 2 with a simple sliding movement. It will be observed that arms 4 need not contact the floor. Inasmuch as the weight of persons sitting or lying on the horizontal surfaces of extensible bed frame 2 is carried entirely by the legs supporting the stationary, first movable and second movable sections, rather than by the arms as in conventional sofa beds, neither the connection formed by end frame member 8 and connector 37 nor arms 4** themselves need provide substantial mechanical integrity. Hence, a significant savings in materials and weight results.

To facilitate assembling arms 4 to the extensible bed frame 2, one or more wheeled casters, such as those illustrated at 38, may be provided at the lower edge of arms 4 so as to just rest on the upper surface of the floor when the arms are secured to the extensible bed frame. Since casters 38 bear an insignificant load, they may be of light weight construction.

In the preferred embodiment, a sofa-type back 5 is also provided and extends between the rearmost ends of arms 4. Back 5 comprises a vertical support **5*a* extending substantially the distance between arms 4. Vertical support 5*a* terminates at its upper end in a hollow overhanging box-like rear support 5*b* which provides the actual back support for the assembled sofa bed. As can best be seen in FIG. 2, rear support 5*b*** provides a storage cavity for the mattress of the sofa bed, as will be described in more detail hereinafter.

It will be further observed that sofa back 1 does not support any portion of frame 2; rather, sofa back 5 is removably attached to arms 4 by means of slotted attaching members, one of which is shown at 40, secured to the ends or back of sofa back 5 and connecting pins 41 extending outwardly from the inner surface of arms 4. Slotted attaching member 40 comprises one or more downwardly and forwardly extending slots dimensioned to accept mushroom-shaped pins 41 to secure sofa back 5 to arms 4.

Sofa bed 1 may also be provided with a foot board 6 having a pair of mushroom-shaped connecting pins 42 extending from the rear surface thereof which are insertable in keyhole-shaped slots 43 positioned on the forward surface of angle-shaped legs 32 of second movable section 25. Foot board 6 is thus easily removable from frame 2 for shipment or storage.

Sofa bed 1 also contains a single piece mattress 3 constructed of foam or other resilient material. In the embodiment of FIG. 1 and FIG. 2, approximately the rearmost ⅓ portion **3*a* of mattress 3 is hinged as at 45 so that the hinged portion 3*a* may be folded to overlie a portion of mattress 3 adjacent rearmost portion 3*a*, thus forming a double thickness mattress section, with the remainder of the mattress being of a single thickness. When the mattress is unfolded, it presents a substantially planar sleeping surface. However, when the sofa bed is used as a sofa, hinged portion 3*a* may be folded forwardly, as is best shown in FIG. 2, and the double thickness mattress section thus formed slid rearwardly and upwardly into the hollow cavity of sofa back 5, such that the single thickness mattress section 3*b* overlies horizontal resilient surface 14 of stationary section 7 to form a seating surface. Thus not only is mattress storage easily facilitated, but the height of the seating surface formed by the upper surface of single thickness mattress section 3*b* is considerably reduced over prior art designs, thereby producing a sofa bed having a contemporary appearance. Furthermore, mattress 3** is not subjected to damaging sharp folds as in conventional sofa bed arrangements.

Figure 5:
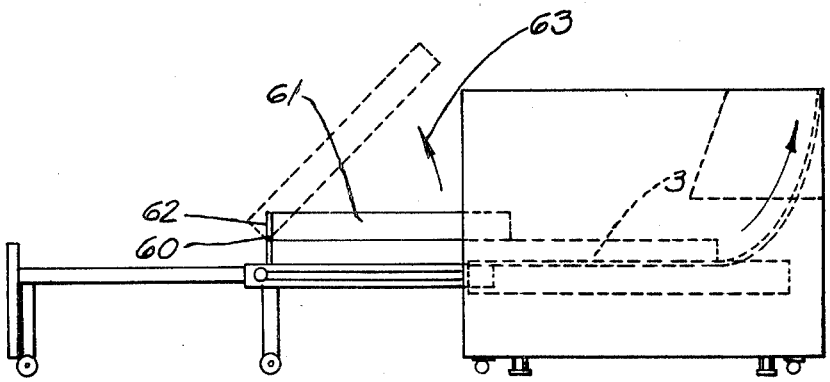
FIG. 5 is a side elevation view of the sofa bed of the present invention supporting a front hinged mattress.

In an alternative embodiment illustrated in FIG. 5, the forwardmost portion of mattress 3 is hinged as at 60, to provide a double thickness cushion-like seating surface consisting of hinged portion 61 overlying a portion of mattress 3 adjacent the forwardmost end of the bed.

The upper surface of hinged portion 61 and the sides thereof may be covered with a suitable upholstery-type fabric so that hinged portion 61 may serve as a cushion for the sofa. In addition, the forwardmost edge presented by the folded mattress may be provided with a suitable upholstery-type fabric flap 62 loosely secured to the uppermost edge of hinged portion 61 and the lowermost edge of the forwardmost part of mattress 3 underlying hinged portion 61. Thus flap 62 permits the forwardmost edge of the folded mattress to present a pleasing appearance while permitting hinged portion 61 to be unfolded in the direction shown by arrow 63 to assume a planar position similar to that illustrated in FIG. 2 in connection with the rear hinged mattress. It will be understood that in the embodiment of FIG. 5, the rearmost single thickness portion of the mattress slides upwardly and rearwardly into the hollow back of the sofa in a manner similar to that described hereinbefore in connection with the embodiment of FIG. 2.

To facilitate sliding the rearmost section of the mattress upwardly and rearwardly into the hollow sofa back 5, one or more curved slat-like guide members constructed of wood or other formable material, one of which is shown at 44, may be provided extending from the rearmost edge of resilient surface 14 of stationary section 7 rearwardly and upwardly into hollow sofa back 5. Thus the lower surface of the rearmost section of mattress 3 can rest upon guide members 44 to be guided upwardly and rearwardly in the direction of arrow 45 along the guide members.

It will be understood that arms 4, sofa back 5 and foot board 6 may be provided with suitable upholstery or other covering as required. It will be further understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive privilege or property is claimed are as follows:

1. A convertible sofa bed having a closed position forming a seating unit and an opened position forming a bed, said sofa bed comprising:

a self-supporting rectangular frame-like horizontal stationary section having a pair of spaced parallel end frame members, said members supporting a resilient horizontal surface defining a seating platform when said sofa bed is in the closed position;

a plurality of spaced load-bearing legs depending from and attached to the peripheral edge of said stationary section for supporting substantially entirely said section from the floor;

a first movable rectangular frame-like section formed by a pair of spaced parallel end frame members, said first movable section frame members supporting a resilient horizontal surface, said first movable section being slidable between said closed position wherein said first movable section underlies said stationary section, and an opened position wherein said first movable section is slid outwardly from said stationary section to a position where said horizontal resilient surfaces of said stationary and first movable section are substantially co-planar;

first connecting means joining said stationary section and said first movable section to permit linear sliding movement therebetween;

a second movable rectangular frame-like section formed by a pair of spaced parallel end frame members, said second movable section being slidable between said closed position wherein said second movable section underlies said first movable section, and an opened position wherein said second movable section is slid outwardly from said first movable section to a position where said horizontal resilient surfaces of said first and second sections are substantially co-planar; and second connecting means joining said first and second movable sections to permit linear sliding movement therebetween.

2. The sofa bed according to claim 1 wherein said first movable section end frame members are disposed inwardly of said stationary section end frame members, and wherein said first connecting means comprises an elongated slot inscribed longitudinally in said end frame members of said stationary section and a rod-like bearing pin extending outwardly through said slot from the rearmost end of each of said end frame members of said first movable section such that said bearing pin slidably communicates with said slot, and said second connecting means comprises an elongated slot inscribed longitudinally in said end frame members of said first movable section and a rod-like bearing pin extending through said slot outwardly from the rearmost end of each of said end frame members of said second movable section slidably communicating with said slot of said first movable section.

3. The sofa bed according to claim 1 including knock-down means comprising a pair of furniture-type arms and means removably attaching each of said arms to a corresponding one of said end frame members of said stationary section.

4. The sofa bed according to claim 3 wherein said attaching means slidably attaches said arm to said end frame member.

5. The sofa bed according to claim 4 wherein said stationary section end frame member includes spaced upwardly and downwardly directed flanges extending substantially the length of said stationary section end frame member, and the surface of said arm adjacent said stationary section includes an upper elongated downwardly extending lip and a lower elongated upwardly extending lip positioned below and parallel to said upper lip, said upper lip slidably receiving said upwardly directed flange, and said lower lip slidably receiving said downwardly directed flange to attach said arm to said stationary section.

6. The sofa bed according to claim 3 including a sofa back extending between and removably secured to the rearmost portion of said arms said back comprising a substantially hollow box-like frame supporting a resilient forward facing support surface.

7. A sofa bed according to claim 6 wherein said forward facing support surface depends downwardly from the upper forwardmost edge of said back, the lower edge of said forward facing support surface being vertically spaced from said resilient horizontal surface of said stationary section to form an opening therebetween extending substantially the width of said horizontal surface of said stationary section, said sofa bed including guide means extending upwardly into said back from the rear portion of said stationary section.

8. The sofa bed according to claim 7 wherein said guide means comprise a plurality of spaced slat-like guide members.

9. The sofa bed according to claim 7 wherein said sofa bed includes a resilient mattress, said mattress being hinged so that a portion of said mattress may be folded to overlie the rest of said mattress to form a double thickness mattress section and a single thickness mattress section, said mattress being configured to overlie said stationary section, said first movable section, and said second movable section to present a substantially planar upper surface when said sofa bed is in said opened position, some at least of said mattress being slid rearwardly and upwardly along said guide means into said sofa back when said sofa bed is in said closed position such that a portion of said mattress overlies said horizontal surface of said stationary section to form said seating surface.

10. The sofa bed according to claim 9 wherein said mattress is hinged such that the rearmost portion of said mattress may be folded to overlie a portion of said mattress adjacent said rearmost portion to form a double thickness mattress section, the remainder of said mattress being of a single thickness, said mattress being configured to overlie said stationary section, said first movable section, and said second movable section to present a substantially planar upper surface when said sofa bed is in said opened position, said double thickness mattress section being slid rearwardly and upwardly along said guide means into said sofa back when said sofa bed is in said closed position such that a portion of said single thickness mattress section overlies said horizontal surface of said stationary section to form said seating surface.

11. The sofa bed according to claim 9 wherein said mattress is hinged such that the frontmost portion of said mattress may be folded to overlie a portion of said mattress adjacent said frontmost portion to form a double thickness mattress section, the remainder of said mattress being of a single thickness, said mattress being configured to overlie said stationary section, said first movable section, and said second movable section to present a substantially planar upper surface when said sofa bed is in said opened position, said single thickness mattress section being slid rearwardly and upwardly along said guide means into said sofa back when said sofa bed is in said closed position such that a portion of said double thickness mattress section overlies said horizontal surface of said stationary section to form said seating surface.

12. The sofa bed according to claim 11 wherein the surfaces of said mattress exposed to view when said sofa bed is in said closed position are covered with an upholstery-like material.

13. The sofa bed according to claim 12 wherein the lowermost adjacent edges of said frontmost portion of said mattress and said portion of said mattress adjacent said frontmost portion are joined by a web-like flap of said upholstery-like material extending transversely of said mattress such that the forwardmost edge of said double thickness mattress section presents a substantially continuous surface.

14. The sofa bed according to claim 3, wherein said knock-down means further includes a foot board section removably secured to the forwardmost edge of said second movable section.

15. A convertible sofa bed having a closed position forming a seating unit and an opened position forming a bed, said sofa bed comprising;

a stationary frame-like section and at least one movable frame-like section linearly extensible from and connected to said stationary section, each of said sections having a substantially horizontal support surface, said surfaces being arranged in substantially parallel stacked relationship when said sofa bed is in said closed position, said surfaces being arranged in substantially co-planar relationship when said sofa bed is in said opened position;

a sofa back adjacent said stationary section, said sofa back having a hollow storage enclosure; and a resilient mattress positioned on said sofa bed, said mattress being hinged so that a portion of said mattress may be folded over a part of the remainder of said mattress to form a double thickness mattress section and a single thickness mattress section, said mattress being configured to overlie said co-planar surfaces to form a substantially planar upper surface when said sofa bed is in said opened position, a portion at least of said mattress being slid into said hollow storage enclosure of said sofa back when said sofa bed is in said closed position such that a portion at least of said mattress overlies said stationary frame-like section to form a seating surface.

16. A convertible sofa bed according to claim 15 wherein a portion at least of said double thickness mattress section is slid into said hollow storage enclosure of said sofa back when said sofa bed is in said closed position such that a portion at least of said single thickness mattress section overlies said stationary frame-like section to form said seating surface.

17. A sofa bed according to claim 16 wherein a portion at least of said single thickness mattress section is slid into said hollow storage enclosure of said sofa back when said sofa bed is in said closed position such that a portion at least of said double thickness mattress section overlies said stationary frame-like section to form said seating surface.

18. A convertible sofa bed according to claim 17 wherein the surfaces of said mattress exposed to view when said sofa bed is in said closed position are covered with an upholstery-like material.

19. The sofa bed according to claim 18 wherein the transverse edges of said folded portion and said remainder of said mattress forming said double thickness mattress section are joined by a web-like flap of said upholstery-like material such that the forwardmost edge of said double thickness mattress section presents a substantially continuous surface.

20. A convertible sofa bed having a closed position forming a seating unit and an opened position forming a bed, said sofa comprising a stationary frame-like section and at least one movable frame-like section linearly extensible from and connected to said stationary section, each of said sections having a substantially horizontal support surface including resilient support means for supporting an occupant, said surfaces being arranged in substantially parallel stacked relationship when said sofa bed is in said closed position, said surfaces being arranged in substantially co-planar relationship when said sofa bed is in said opened position such that each of said support surfaces forms an occupant reclining surface, and a plurality of spaced load-bearing legs depending from and attached to said stationary section for supporting substantially entirely said stationary section from the floor.

* * * * *